United States Patent [19]

Bonfield

[11] 3,985,389

[45] Oct. 12, 1976

[54] WHEELCHAIRS

[75] Inventor: Robert B. Bonfield, Alresford, England

[73] Assignee: Bardic Engineering Limited, Southampton, England

[22] Filed: June 23, 1975

[21] Appl. No.: 589,791

[30] Foreign Application Priority Data

July 24, 1974 United Kingdom ..... 32712/74

[52] U.S. Cl. ..... 297/347; 254/86 R; 254/93 VA; 297/DIG. 4

[51] Int. Cl.[2] ..... A47C 1/02

[58] Field of Search ..... 297/347, 348, DIG. 4; 254/86 R, 93 VA; 5/81 R, 81 B

[56] References Cited

UNITED STATES PATENTS

| | | | |
|---|---|---|---|
| 2,238,445 | 4/1941 | Kilstrom | 297/DIG. 4 |
| 2,676,643 | 4/1954 | Miller et al. | 297/DIG. 4 |
| 3,123,400 | 3/1964 | Paulson | 297/347 X |
| 3,352,461 | 11/1967 | Dascanio | 254/86 R X |

*Primary Examiner*—James C. Mitchell
*Attorney, Agent, or Firm*—Baldwin, Wight & Brown

[57] ABSTRACT

Elevating means for use with a wheelchair said means being adapted to be secured to the side frames of the wheelchair and having hydraulically actuated lifting means which when operated extend downwardly to engage the ground and lift the side frames of the chair upwardly.

21 Claims, 8 Drawing Figures

1
2
3
4
5
6
7
8
9
10
11
12
13
13a
14
15
16
17
18
19
20
21
22
23
24
33
34
35
37
38
40
41
48
49

WHEELCHAIRS

This invention relates to elevating means for use with a wheelchair, wheelchairs incorporating such elevating means and to a hydraulic pump suitable for powering such elevating means.

For stability and for ease of access and egress the seat portion of wheelchairs is normally provided at a relatively low level and this causes particular difficulty for handicapped persons confined to wheelchairs since kitchen working surfaces, hand basins and work benches are normally provided at a height suitable for a standing person and are thus much too high for the person in the wheelchair.

Such persons also suffer psychological disadvantage when talking to persons who are standing up, since they necessarily have to look-up to such persons rather than being able to look at them at eye level.

The most widely used type of wheelchairs are those which comprise two substantially rigid side frames each mounting one large wheel and one small wheel and, extending between and coupling the side frames, lockable folding struts and a canvass seat and back rest. Such wheelchairs can readily be folded, by collapsing the lockable folding struts, so that they can be stored in the luggage compartment of for example a motor vehicle or can be unfolded so that the side frames are spaced apart, the lockable folding struts being locked so that a person can sit on the canvas seat and lean against the back rest. The elevating means in the present invention are particularly although not exclusively applicable for use with such wheelchairs.

According to the present invention elevating means for use with a wheelchair are adapted to be secured to the side frames of the wheelchair and have hydraulically actuated lifting means which when operated extend downwardly to engage the ground and lift the side frames of the chair upwardly.

In a preferred embodiment the elevating means comprise a pair of extendable frameworks each adapted to be secured to a respective side frame of the wheelchair and, on hydraulic means to cause such frameworks to extend to cause part of each of said frameworks to engage the ground and lift the side frames.

The part of each said framework which engages the ground may conveniently comprise a bar which lies along the ground when engaged therewith.

Each hydraulic means may include a pair of hydraulic rams each associated with one of the extendable frameworks and the rams can be supplied with hydraulic fluid from a common manually operable pump, the rams being cross-connected so that they extend and retract equally, thereby ensuring that the chair is no tipped sideways as it is elevated or lowered.

The hydraulic rams can be connected to the pump so that when pressure fluid is pumped in one direction from the pump it is supplied to one side of a piston in one of the rams, fluid from the other side of said piston being transmitted to one side of the piston of the second ram, fluid in the other side of the piston in the second ram being connected to relief or the pump.

In one preferred embodiment the piston of each ram has a connecting rod which extends through the cylinder to one side of the piston, the diameter of one of the cylinders being smaller than the other to compensate for fluid transferred from one to the other during operation.

In a convenient construction each framework includes a pair of telescopic guide tubes, the guide tubes and hydraulic rams of each framework being angled to the ground engaging bar so that the chair is moved rearwardly relatively to the ground engaging bars as it is elevated.

Advantageously the ground engaging bars are each inclined to the ground when in a raised position with their forward ends lowermost so that the chair is tilted rearwardly slightly upon elevation after the ground engaging bars have initially engaged the ground.

The hydraulic rams are preferably connected to the manually operable pump by flexible hydraulic pipes and are otherwise disposed so that the chair can be folded into a closed position with the elevating means fitted.

The two frameworks may thus each be arranged to be clamped to a respective side frame of the chair in a readily releasable manner.

The rams may be arranged so that the chair can be elevated by a distance of 9 to 12 inches.

The elevating means preferably also include a manually operable pump incorporating means for selecting the direction of fluid flow through it, alteration in the direction of fluid flow thus allowing for the rams to be raised or lowered.

In a preferred embodiment the pump includes a piston which can be reciprocated in a pumping cylinder to provide a fluid pressure and valve means for selecting a pressurised fluid flow path from the pumping cylinder to either first or second connecting ports which are connected respectively to the hydraulic rams and the selective valve means can provide a fluid flow path from the first or second connecting port which is not connected into the pressurised flow path.

Thus the hydraulic pump can be caused to pump fluid selectively in one direction or in the other direction merely by operation of the selective valve.

First and second non-return valves can be provided in a fluid flow path each side of the pumping cylinder and arranged so that fluid drawn into the cylinder through the first valve is expelled under pressure through the second, thus ensuring that the pressure fluid flows in the desired direction.

Preferably the selective valve means acts to direct pressurised fluid from the second valve to one or other of the connecting ports.

In the arrangement set forth above two cylinders and pistons can be provided and they can be arranged so that they are co-axial and opposed, the pistons being driven by a manually operated rocking mechanism.

In any case, the pump is preferably provided with means for clamping it to one of the side frames of the chair.

An altenative form of hydraulic pump for use with the invention comprises a piston reciprocable in a cylinder, a pair of valves and means for presetting the valves to either a first of a second position, said valves each having a respective valve member movable with respect to the valve and co-operating with respective first and second seats such that when the valves are set in said first position the valve member of said first valve co-operates with its first respective seat and acts as an inlet valve for said cylinder and the valve member of said second valve cooperates with its second respective seat and acts as an outlet valve for said cylinder and when the valves are set in said second position the valve member of said first valve co-operates with its second respective seat and acts as an outlet valve for said cylinder and the valve member of said second valve co-operates with its first respective seat and acts as an inlet valve for said cylinder.

Thus the hydraulic pump can be caused to pump fluid selectively in one direction or in the other direction by changeover of the valves between the first and second positions.

Thus each of the valves can be set in a position such that the valve member thereof can float between a neutral position and a position in which it co-operates with one of its valve seats to prevent flow of pressurized fluid from the cylinder, flow of fluid into the cylinder being allowed with the valve member in its neutral position or can be set in a position in which the valve member floats between a neutral position and a position in which it co-operates with the other of its valve seats to prevent flow of fluid into the cylinder when a suction is drawn in the cylinder by movement of the piston.

The invention can be performed in various ways and a number of embodiments are shown in the accompanying drawings in which:

FIG. 1 is a side view of a folding wheelchair of known kind fitted with elevating means according to the invention, FIG. 2 is a schematic diagram showing a first embodiment of hydraulic circuit for elevating means according to the invention, FIG. 3 shows an alternative embodiment of hydraulic circuit to that shown in FIG. 2, FIG. 4 is a sectional elevation through a hydraulic pump suitable for use for powering the hydraulic elevating means according to the invention shown in FIG. 3, FIG. 5 is a part sectional end view taken in the direction of arrow A of FIG. 4.

Figures 1, 5:
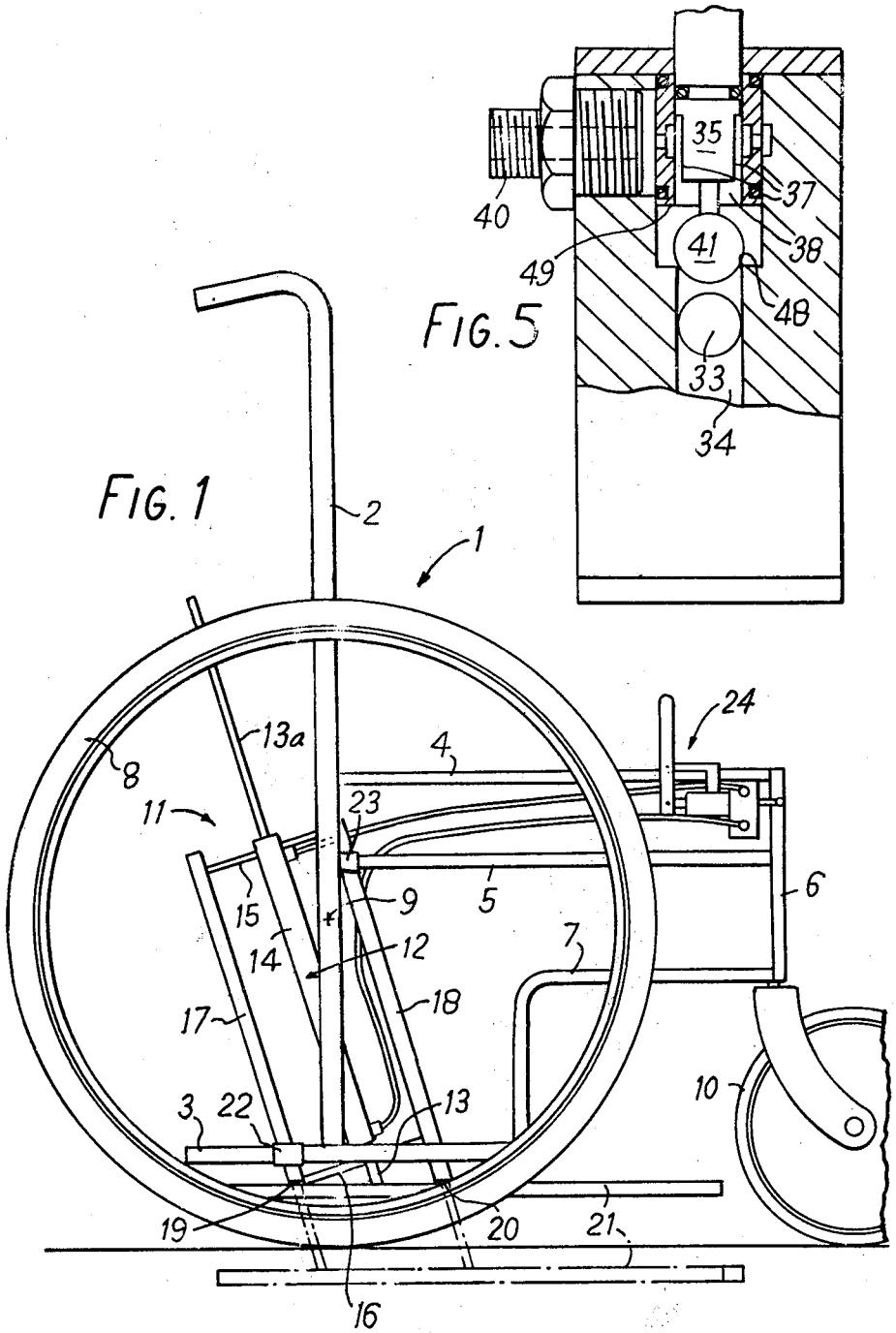

Referring to FIG. 1 a wheelchair generally indicated at 1 has a pair of rigid side frames, only one of which is shown in the drawings, each side frame comprising an upright bar 2, a lower horizontal bar 3, upper horizontal bars 4 and 5, a front vertical bar 6 the bottom end of which is coupled to the lower horizontal bar 3 by an angled member 7, a large wheel 8 mounted for rotation on an axis indicated at 9 and a small wheel 10 mounted on a castor at the lower end of the vertical member 6.

Each side frame is coupled to the other side frame by folding lockable struts (not shown) and by a canvas seat (not shown) which is supported between the upper horizontal bars 4 and a canvas back-rest (not shown) which is supported between the upper ends of the upright bars 2.

By collapsing the folding lockable struts the two side frames can be brought into close proximity with one another to enable the wheelchair to be stowed for example in the luggage compartment of a motor car.

FIG. 1 shows that the wheelchair 1 is provided with hydraulic elevating means generally indicated at 11 and comprising, for each side frame, a framework comprising a piston-cylinder arrangement 12 having a piston rod 13, 13*a* passing right through a cylinder 14, cross struts 15 and 16 and guide tubes 17 and 18 containing guide rods 19 and 20 respectively. The bottom ends of the piston rod 13 and the guide rods 19 and 20 are secured to a bar 21 which can be pushed downwardly into engagement with the ground on which the chair is standing. The frameworks are each clamped to a respective one of the sideframes by means of clamp brackets 22 and 23 which are secured to the guide tubes 17 and 18 respectively and are clampable respectively onto the lower horizontal bar 3 and the lower one 5 of the upper horizontal bars of the side frame. Flexible hydraulic tubes connect the cylinder 14 to a hand pump 24 mounted on the upper one 4 of the upper horizontal bars of the side frame on one side of the chair, that is to say only one pump 24 is provided for the chair.

It can be seen that pressure fluid supplied to the cylinder 14, above a piston therein secured on the rod 13, 13*a* will cause the rod to move downwardly in the cylinder to press the bar 21 against the ground and subsequently to raise the whole chair upwardly as indicated in broken lines in FIG. 1. Preferably the bar 21 is initially angled so that its front end is lower than its rear end so that the chair is tipped slightly rearwardly following engagement of the front end of the bar 21 with the ground and the rods 13,19 and 20 are secured to the bar at an angle such that the chair moves rearwardly as it is elevated. Supply of pressure fluid to the cylinder 14 beneath the piston therein will allow the chair to sink to ground level and will then raise the bar 21 clear of the ground to the position shown in full lines in FIG. 1.

Figure 2:
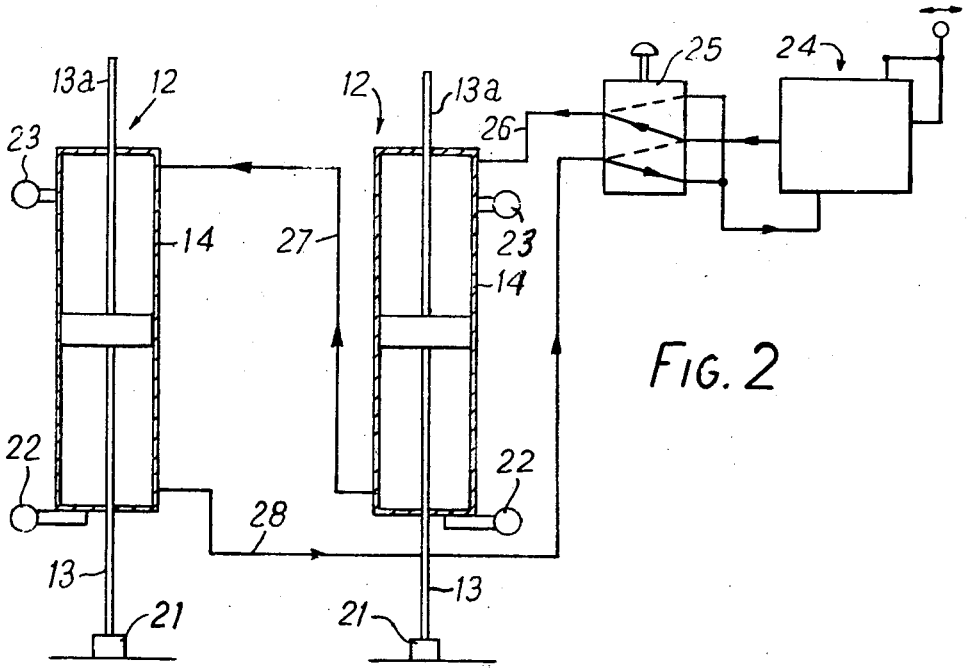

FIG. 2 shows a hydraulic circuit for the chair 1 of FIG. 1, only the brackets 22, 23 are shown and not the side frames of the chair 1, however, it will be appreciated that when the cylinders 14 move upwardly or downwardly the chair will move with them.

When the chair is to be elevated the reversible pump 24 supplies fluid through a five port valve 25 and pipe 26 to the first (i.e., right hand) cylinder 14 above the piston theein causing the piston and rod 13, 13*a* to move downwardly with respect to the cylinder. Such downward movement forces fluid through a connection pipe 27 from the lower end of the first cylinder into the upper end of the second cylinder 14 to cause the rod 13, 13*a* of the second cylinder to move downwardly by the same amount as that of the first cylinder and to force fluid through a pipe 28 back to the valve 25 and thence to the pump 24 to be fed again to the top of the first cylinder 14. Thus the whole circuit is always completely flooded and only a very small reservoir is required for hydrauic fluid to allow for any leaks.

The chair will rise evenly ithout sideways tilting without great effort being required to operate the pump.

By changing over the valve 25 to the connections indicated in dotted lines, operation of the pump will cause the chair to be loweed and the bar 21 raised from the ground.

Figure 3:
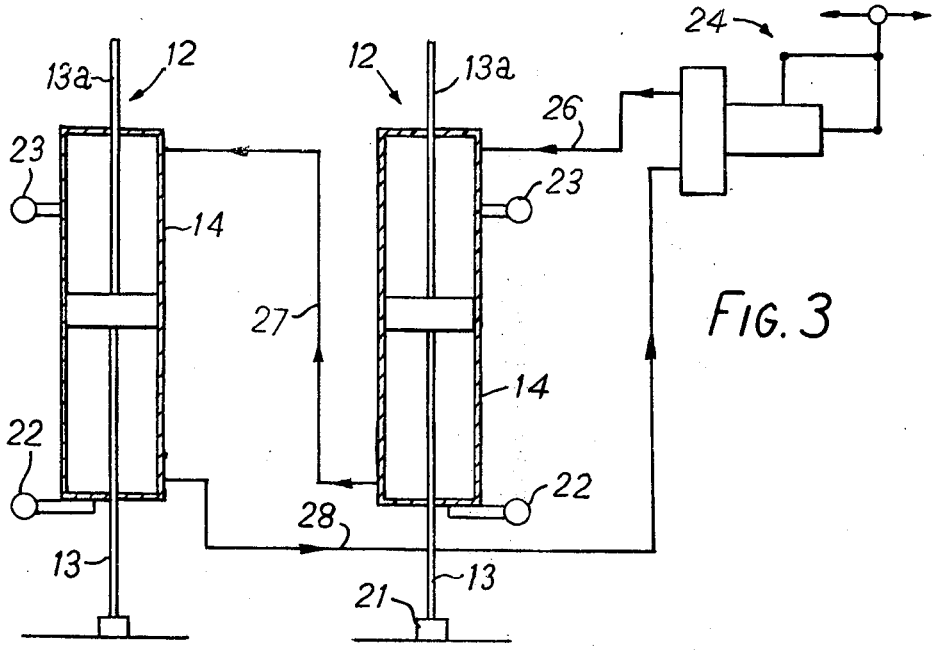

In the embodiment of FIG. 3 the valve 25 is omitted and a reversible pump 24 is provided.

Figure 4:
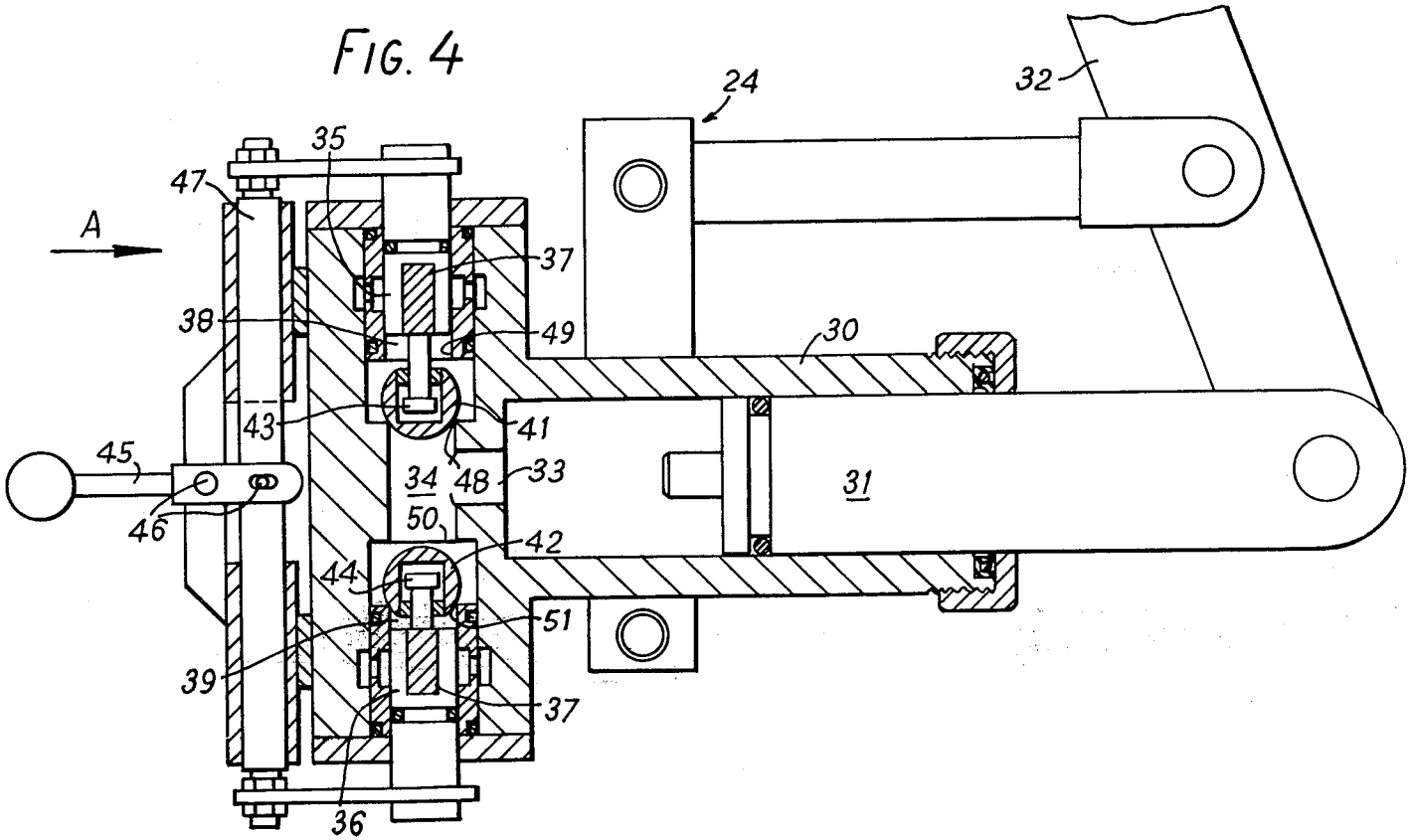

Referring to FIGS. 4 and 5, the pump 24 comprises a housing defining a cylinder 30 in which a piston 31 can be manually reciprocated by means of a pivoted lever 32. The cylinder 30 is in communication through a passage 33 with a cross bore 34. Mounted in enlarged diameter end portions of the cross bore 34 are valves 35 and 36 having flats 37 thereon whereby a chamber 38, 39 respectively of each valve 35, 36 is in communication with a respective connecting port, only one 40 of which is shown (FIG. 5). A respective valve member 41, 42 of the valves 35, 36 is mounted to float axially with respect to the valve and as shown is a substantially spherical member with an inner chamber having end walls co-operating with end portions 43, 44 of the valves 35, 36 respectively. The valves 35, 36 are slidable in the cross bore 34 by means of a lever 45, a linkage 46 and a slidable rod 47 which is coupled at its ends rigidly to the outer ends of the valves 35, 36. For each valve a pair of seats is provided to co-operate with the respective valve member 41, 42. For the valve 35 these comprise an inner seat 48 and an outer seat 49 and for the valve 36 an inner seat 50 and an outer seat 51.

The amount of float allowed for each valve member 41, 42 on its respective end portion 43, 44 of the valves is not sufficient to allow the valve member to move between its respective seats 48, 49 or 50, 51. By operating the lever 45 however the valves 35, 36 can be moved to a first position in which the valve member 41 can float between a neutral position and a position at which it co-operates with its seat 48, thereby to prevent flow of fluid into the cylinder 31 through the valve 35 upon rightward movement of the piston 31 as shown but to allow flow of fluid outwardly through the valve 35 upon leftward movement of the piston, thus causing the valve 35 to act as an outlet valve. In the first position the valve member 42 floats between a neutral position in which it co-operates with its seat 51 thereby to prevent outward flow of fluid through the valve 36 but to allow flow of fluid inwardly into the cylinder 30 and thus act as an inlet valve. Alternatively the lever 45 can be operated to position the valves 35, 36 in a second position so that the valve member 41 floats between a neutral position and a position at which it co-operates with its seat 49 and acts as an inlet valve while the valve member floats between a neutral position and a position at which it co-operates with its seat 50 and acts as an outlet valve.

The valve members 41, 42 could alternatively by cylindrical members with sealing faces or membes at their ends and could incorporate relief valves to limit the pressure applied to the hydraulic system, the relief valve of the valve which acts as an outlet valve upon elevation of the chair for example being set to blow at 600 p.s.i. and the relief valve of the valve that acts as an outlet valve upon lowering of the chair and which effectively is only required to lift the bar 21 off the ground being set for example to blow at 30 p.s.i. When the valves do blow they advantageously vent the pressure chamber of the pump to the suction side of the pump and thereby avoid risk of damage to the seals provided in the cylinder 14.

Figure 6:
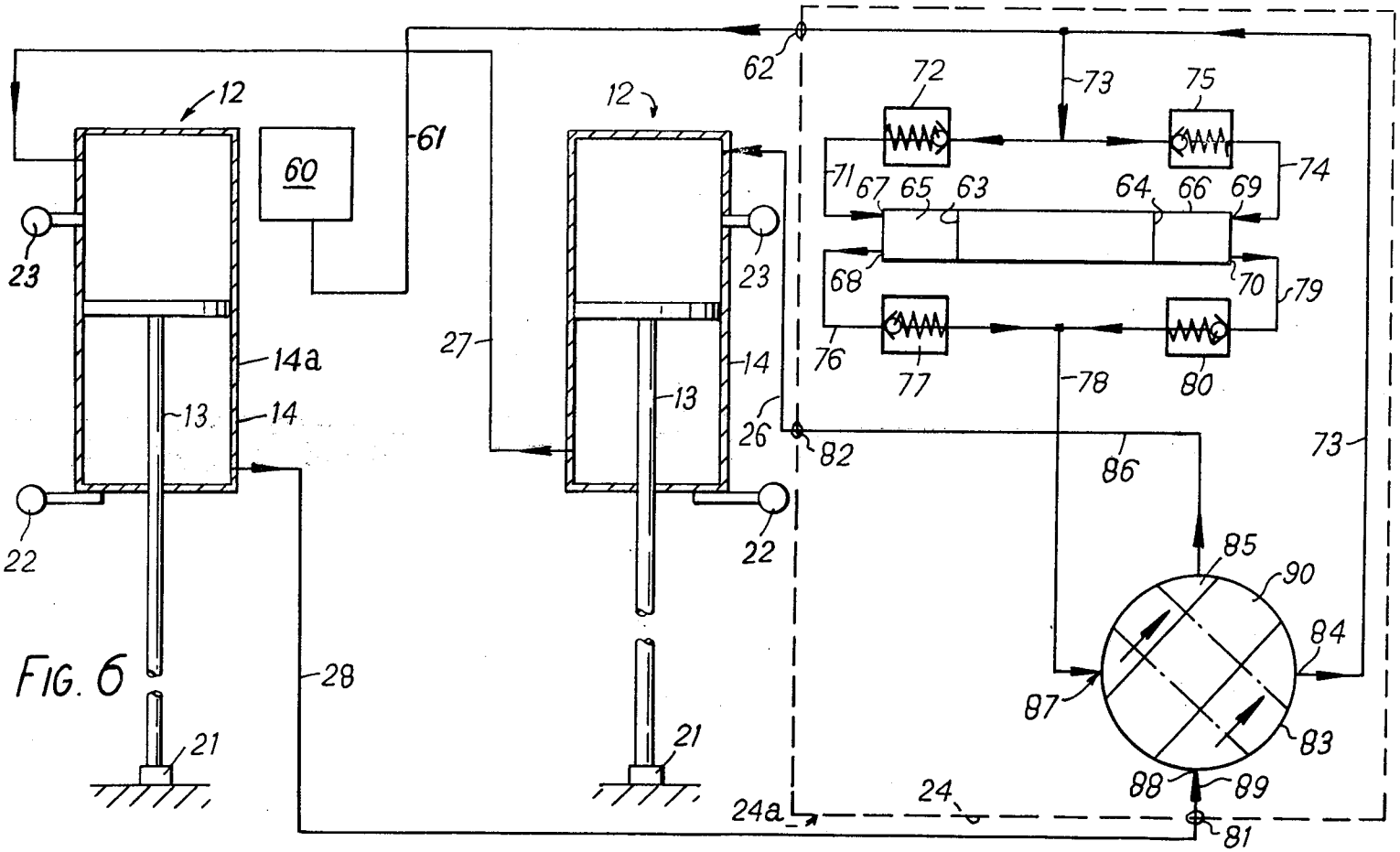
FIG. 6 shows another alternative embodiment of hydraulic circuit.

FIG. 6 shows an alternative hydraulic circuit for a chair similar to that shown in FIG. 1 but using a different form of pump. The same reference numerals are used to indicate the similar parts to those shown in FIGS. 2 and 3 but in this case the upper end 13*a* of piston rod 13 is removed and in order to balance the system the diameter of the left hand cylinder 14, indicated as 14*a* in this Figure is reduced to compensate for the lack of the piston rod 13*a* above the piston in the left hand cylinder. When fluid is transferred from beneath the piston the left hand cylinder however it passes through the pump and is compensated by drawing fluid from a reservoir indicated by reference numeral 60 which is connected via a line 61 to a bore 62 in the pump which is hereinafter to be described. This pump has two opposed pistons 63 and 64 which act in cylinders 65 and 66. The cylinder 65 has an inlet port 67 and an outlet port 68 and the cylinder 66 similar ports 69 and 70. The inlet port 67 is connected to a passage 71 to a non-return 72 which allows fluid to enter the cylinder 65 from a supply passage 73. Similarly the port 69 is connected via a passage 74 through a non-returnvalve 75 to the same fluid supply passage 73. The outlet port 68 is connected to a passage 76 through a non-return valve 77 to an outlet passage 78 and the outlet port 70 is connected to a similar arrangement consisting of passage 79 and a non-return valve 80 to the outlet passage 78. This fluid is supplied to the pistons through the inlet passage 73 and is delivered under pressure through the outlet passage 78.

The pump has two communicating ports which are indicated diagrammatically at 81 and 82 the support 82 is connected to the pipe 26 which leads to the top of the right hand cylinder 14 and the port 81 is connected to the pipe 28 which leads to the bottom of the left hand cylinder 14*a*. In order to control the direction of the flow to the cylinder 14 and 14*a* a rotary valve is provided for selecting a pressurised fluid flow from the pump cylinders 65 and 66 to either of the connecting ports 81, 82. This rotary valve is indicated by reference numeral 83 and has four ports. Port 84 is connected to fluid inlet passage 73, port 85 is connected via passage 86 to connecting port 82, port 87 is connected to outlet passage 78, and port 88 is connected via passage 89 to connecting port 81 as indicated in full lines in FIG. 6, the rotary member 90 of the valve is connecting port 87 to port 85 and port 84 to 88 and the direction of flow through the system is indicated by the arrows. Thus, when the pistons 63 and 64 are operated fluid is drawn from the inlet passage 73 through the non-return valves 72 and 75 up to the ports 67 and 69 of the cylinders 65 and 66. It cannot return along these routes because of the non-return valves 72 and 75. As the pistons are operated the fluid is pumped out of the ports 68 and 70 into the lines 76 and 79, through the non-return valves 77 and 80 and into the fluid outlet passage 78 under pressure. It passes through port 87 in the rotary valve to port 85, through line 86 and out of the connecting port 82 into the pipe 26 and thence to the cylinder 14. Fluid beneath the piston in the cylinder 14 is transferred through pipe 27 to the upper part of cylinder 14*a* where it forces the piston in that cylinder down on the lower part of the cylinder is relieved through pipe 28 which leads to connecting port 81 on the pump 24. From the connecting port 81 it passes through line 89, through the port 88 in the rotary valve, out of th port 84 and into the inlet passage 73. This passage 73 is also connected to port 62 and leads to the reservoir 60 from which extra fluid can be drawn. Thus the direction of movement is as described above.

If the rotary member 90 of the rotary valve is now turned to the position shown in broken lines fluid under pressure at the port 87 of the rotary valve is directed to port 88 and into pipe 28 to supply pressure fluid beneath the piston of the lefthand cylinder 14*a*. At the same time fluid above the piston in the right hand cylinder 14 is relieved through pipe 26 to the connecting port 82 thence to the valve port 85 which is now connected to valve port 84 and thus allows the relieved fluid to pass into the passage 73.

The rotary valve therefore acts to select the direction of fluid flow through the pump to either of the connecting ports 81 or 82.

Figure 7:
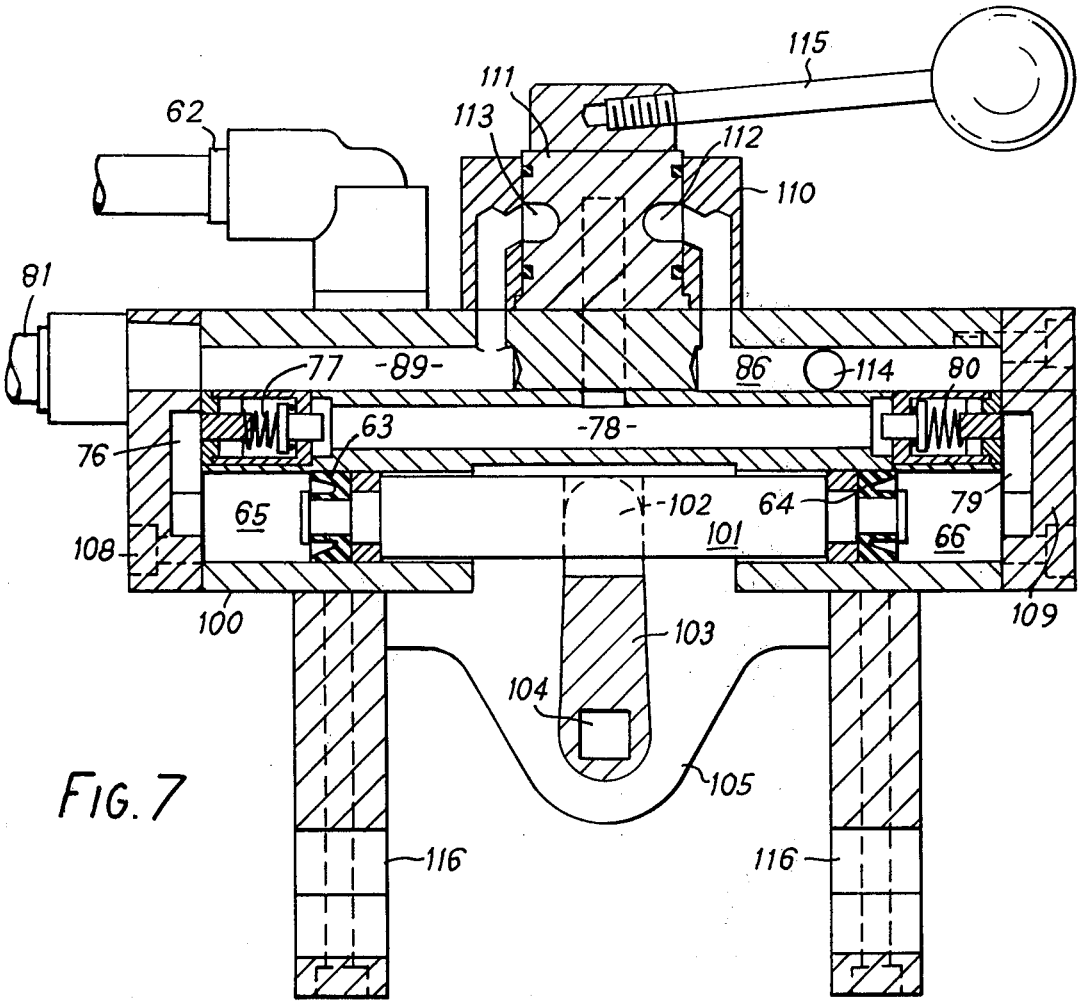
FIG. 7 is a cross sectional side elevation on the line VII—VII on FIG. 8 of an alternative form of pump.
Figure 8:
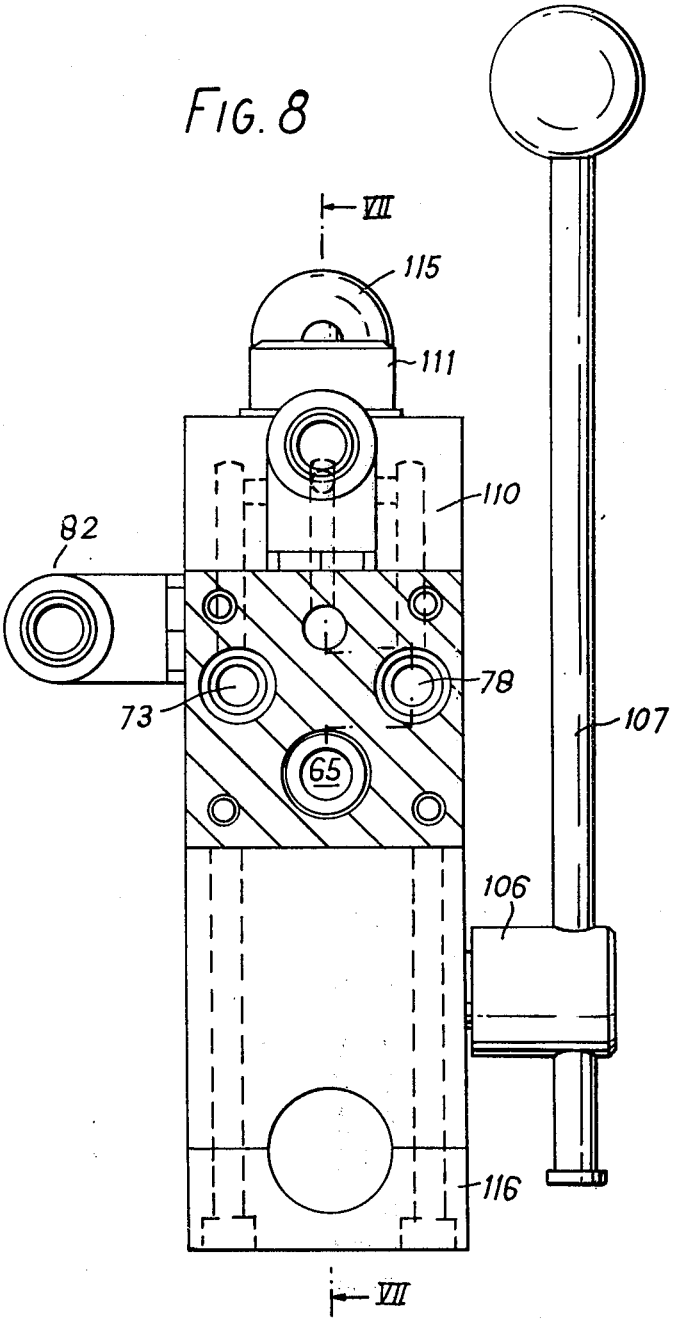
FIG. 8 is a cross sectional and elevation on the line VIII—VIII on FIG. 7.

The construction of the pump is shown in more detail FIGS. 7 and 8, the cylinders 65 and 66 are formed in a housing block 100 and the pistons 63 and 64 are mounted on a piston member 101 which has a central opening 102 in which is located a rocker arm 103 which is located on a square spindle 104. The spindle is carried in a bore a mounting block 105 and the outer end of the spindle is cylindrical, as indicated at 106 and carries an operating lever 107. Thus when the lever 107 is rocked backwards and forwards piston 101 is reciprocated from side to side. The ports 67 and 68 are formed in an end piece 108 secured to the block 100 and the ports 69 and 70 to an end piece 109 in similar fashion. As will be seen from FIG. 8 the cylinders 65 and 66 are arranged below a pair of galleries which provide the inlet passage 73 and the outlet passage 78. Located in the gallery which forms in the passage 53 are the non-return valves 72 and 75 and the non-return valves 72 and 75 are the non-return valves 77 and 80 are in the passage gallery 78; the passages 71 and 76 are also provided in the block 108 and the passages 74 and 79 in the block 109. As will be seen from FIG. 8 extensions of the passages 73 and 78 extend upwardly and are formed in a sleeve 110 which surrounds a rotatable valve member 111 which forms the rotary valve member 90 shown in FIG. 6. This rotary valve member has appropriate passages 112 113 so that the upward extensions of 73 and 78 can be connected to either the passage 89 which is formed as a bore in the block 100 or the passage 86 which is also formed as a bore with an extension 114 which extends at right angles thereto so that the connecting port 82 is to one side of the block. The other connecting port 81 is at one end of the block 100. In order to select the appropriate connecting port which is to be pressurized it is merely necessary to turn the rotary valve member 111 and this is provided with an appropriate operating lever 115.

The port 62 for connection to the reservoir is provided on the upper side of the housing block 111 and leads into the passage 73 although in order to clarify the drawings the bore is not shown.

The housing block 100 is provided with clamps indicated by reference numeral 116 in order to fasten the pump to the side member of the chair.

The pressure fluid used in preferably inhibited water to avoid risk of damage to carpets should seals of the hydraulic system fail.

What we claim is:

1. Elevating means for use with a wheelchair of the type having supporting side frames, said elevating means comprising a pair of extendable frameworks each having a fixed part with means for securement to a respective side frame of wheelchair and a relatively vertically moveable supporting part, and hydraulically actuated lifting means connected between each fixed part and its respective moveable supporting part for moving said moveable support parts downwardly into engagement with a supporting surface to elevate said fixed parts and thereby lift an associated wheel chair.

2. Elevating means for use with a wheelchair as claimed in claim 1 in which each hydraulic means includes hydraulic rams.

3. Elevating means for use with a wheelchair as claimed in claim 2 in which said supporting part of each of said frameworks includes a bar which lies along a supporting surface when engaged therewith.

4. Elevating means for use with a wheelchair as claimed in claim 3 in which the hydraulic rams are supplied with hydraulic fluid from a common manually operable pump.

5. Elevating means for use with a wheelchair as claimed in claim 4 in which the hydraulic rams are hydraulically cross-connected so that the rams extend and retract equally.

6. Elevating means for use with a wheelchair as claimed in claim 5 in which each hydraulic ram includes a piston and a cylinder and said hydraulic rams are connected to the pump so that when pressure fluid is pumped in a direction from the pump said pressure fluid is supplied to one side of a piston in one of the rams, fluid from the other side of said piston of said one ram being transmitted to one side of the piston of the other of said rams, and fluid on the other side of the piston of said other ram being connected to relief on the pump.

7. Elevating means for use with a wheelchair as claimed in claim 6 in which the piston of each ram has a connecting rod which extends through the cylinder to one side of the piston, the diameter of one of the cylinders being smaller than the other to compensate for fluid transferred from said one cylinder to the other cylinder during operation.

8. Elevating means for use with a wheelchair as claimed in claim 3 in which each framework includes a pair of telescopic guide tubes, the guide tubes and hydraulic ram of each framework being angled to the supporting surface engaging bar so that the chair will be moved rearwardly relatively to the supporting surface engaging bars as the chair is elevated.

9. Elevating means for use with a wheelchair as claimed in claim 3 in which the supporting surface engaging bars are each inclined to the supporting surface when in a raised position with their forward ends lowermost.

10. Elevating means for use with a wheelchair as claimed in claim 4 in which the hydraulic rams are connected to the manually operable pump by flexible hydraulic pipes and are otherwise disposed so that a chair with said elevating means fitted thereto can be folded into a closed position.

11. Elevating means for use with a wheelchair as claimed in claim 1 in which said securement means clamp each of the two frameworks to a respective side frame of the chair in a readily releasable manner.

12. Elevating means for use with a wheelchair as claimed in claim 4 in which the manually operable pump incorporates means for selecting the direction of fluid flow through it.

13. Elevating means for use with a wheelchair as claimed in claim 12 in which the pump includes a piston which can be reciprocated in a pumping cylinder to promote a fluid pressure and selecting valve means having first and second ports connected to said hydraulic rams and means for selecting a pressure fluid flow path from the pumping cylinder to either of the first or second connecting ports.

14. Elevating means for use with a wheelchair as claimed in claim 13 in which the selecting valve means also provides a fluid flow path from that end of the first or second parts which is not connected into the pressurized flow path.

15. Elevating means for use with a wheelchair as claimed in claim 13 in which first and second non-return valves are provided in a fluid flow path on each side of the pumping cylinder and arranged so that fluid drawn into the cylinder through said first non-return valve is expelled under pressure through the second non-return valve.

16. Elevating means for use with a wheelchair as claimed in claim 15 in which the selecting valve means acts to divert pressurized fluid from the second non-return valve to a selected one of the connecting ports.

17. Elevating means for use with a wheelchair as claimed in claim 15 in which said pump has two cylinders and pistons.

18. Elevating means for use with a wheelchair as claimed in claim 17 in which the cylinders and pistons are co-axial and opposed, and a manually operated rocking mechanism is operatively connected to said pistons.

19. Elevating means for use with a wheelchair as claimed in claim 4 in which the pump is provided with means for clamping it to are of the sideframes of the chair.

20. Elevating means for use with a wheelchair as claimed in claim 12 in which the pump comprises a cylinder and a piston which can reciprocate in said cylinder, a pair of valves and means for selectively presetting the valves to either a first or a second position, said valves each having a respective valve member moveable with respect to the valve and co-operting with respective first and second seats such that when the valves are set in first position the valve member of said first valve co-operating with its first respective seat and acts as a to said cylinder and the valve member of said second valve co-operates with its second respective seat and acts as an outlet valve to said cylinder and when the valves are set in said second position the valve member of said first valve co-operates with its second respective seat and acts as an outlet valve to said cylinder and the valve member of said second valve co-operates with its first respective seat and acts as an inlet valve to said cylinder.

21. Elevating means for use with a wheelchair as claimed in claim 20 in which each of the valves can be set in a position such that the valve member can float between a neutral position and a position in which it co-operates with one of its valve seats to prevent flow of pressurized fluid from the cylinder, flow of fluid into the cylinder being allowed with the valve member in its neutral position or can be set on a position in which it co-operates with the other of its valve seats to prevent flow of fluid into the cylinder when a suction is drawn on the cylinder by movement of the piston.

* * * * *